US007198170B2

(12) United States Patent
Herr

(10) Patent No.: US 7,198,170 B2
(45) Date of Patent: Apr. 3, 2007

(54) CLOSURE AND CONTAINER SYSTEM AND METHOD FOR SEALING A CLOSURE ON A CONTAINER

(75) Inventor: James E. Herr, Lititz, PA (US)

(73) Assignee: Berry Plastics Corporation, Evansville, IN (US)

( * ) Notice: Subject to any disclaimer, the term of this patent is extended or adjusted under 35 U.S.C. 154(b) by 440 days.

(21) Appl. No.: 10/753,850

(22) Filed: Jan. 7, 2004

(65) Prior Publication Data

US 2005/0145629 A1 Jul. 7, 2005

(51) Int. Cl.
*B65D 41/34* (2006.01)
*B65D 41/36* (2006.01)
*B65D 41/06* (2006.01)

(52) U.S. Cl. ..... 220/293; 215/222; 215/252; 215/330; 215/331; 215/332

(58) Field of Classification Search ..... 215/208, 215/217, 222, 223, 252, 258, 330–332; 220/293, 220/300

See application file for complete search history.

(56) References Cited

U.S. PATENT DOCUMENTS

| | | | |
|---|---|---|---|
| 801,283 | A | 10/1905 | Weissenthanner |
| 1,683,388 | A | 9/1928 | Hammer |
| 2,000,407 | A | 5/1935 | Miller |
| 3,165,220 | A | 1/1965 | Haynes |
| 3,197,055 | A | 7/1965 | Kelly |
| 3,460,703 | A | 8/1969 | Leftault, Jr. |
| 3,692,200 | A | 9/1972 | Ritzenhoff |
| 3,913,772 | A | 10/1975 | Ochs |
| 4,190,169 | A | 2/1980 | Pehr |
| 4,241,842 | A | 12/1980 | Toeppen |
| 4,378,894 | A | 4/1983 | Willis et al. |

(Continued)

FOREIGN PATENT DOCUMENTS

| | | |
|---|---|---|
| DE | 38 42 443 | 8/1989 |

(Continued)

*Primary Examiner*—Anthony D. Stashick
*Assistant Examiner*—Niki M. Eloshway
(74) *Attorney, Agent, or Firm*—Barnes & Thornburg LLP

(57) ABSTRACT

A system includes a container including projections equispaced around a neck region. Each of the projections includes a cam surface, a lock surface, a ramp, and a clamping surface. The system also include a closure including a closure plane and a circumferentially depending outer skirt extending from the closure plane, a tamper-evident arrangement frangibly connected to an edge of the outer skirt opposite the closure plane, and pairs of lugs equispaced around an inner sidewall formed by the outer skirt and the tamper-evident arrangement. A lock lug of each pair of lugs is arranged on the tamper-evident arrangement and a sealing lug of each pair of lugs is arranged on the outer skirt. In the system, each lock lug is adapted to engage the cam surface of a corresponding projection during an initial application operation. The lock lug is adapted to engage the lock surface of the corresponding projection after the initial application operation. In the system each sealing lug is adapted to engage the ramp of the corresponding projection during the initial application operation. The sealing lug is adapted to engage the clamping surface of the corresponding projection after the initial application operation. A number of pairs of lugs may be equal to a number of projections. A method is provided for sealing a closure on a container in a tamper-evident manner using the system. A method is provided for removing a closure from a container sealed with a tamper-evident device.

17 Claims, 5 Drawing Sheets

U.S. PATENT DOCUMENTS

| | | | | |
|---|---|---|---|---|
| 4,380,299 | A | | 4/1983 | Llera |
| 4,448,318 | A | | 5/1984 | Lowe |
| 4,530,438 | A | | 7/1985 | McDevitt |
| 4,534,480 | A | | 8/1985 | Santostasi et al. |
| 4,547,332 | A | | 10/1985 | Drozd, Jr. |
| 4,560,076 | A | | 12/1985 | Boik |
| 4,567,991 | A | | 2/1986 | Anderson |
| 4,700,860 | A | | 10/1987 | Li |
| 4,709,830 | A | | 12/1987 | Kreiseder |
| 4,828,127 | A | | 5/1989 | Young et al. |
| 4,875,594 | A | | 10/1989 | Ochs |
| 4,923,073 | A | | 5/1990 | Wilde |
| 4,936,475 | A | | 6/1990 | Montgomery |
| 5,009,323 | A | | 4/1991 | Montgomery et al. |
| 5,174,465 | A | | 12/1992 | Luch et al. |
| 5,307,945 | A | | 5/1994 | Hidding et al. |
| 5,307,946 | A | | 5/1994 | Molinaro |
| 5,320,233 | A | | 6/1994 | Welch |
| 5,341,947 | A | | 8/1994 | Rosse et al. |
| 5,449,078 | A | | 9/1995 | Akers |
| 5,450,972 | A | | 9/1995 | Zemlo |
| 5,685,445 | A | | 11/1997 | Dobbs |
| 5,749,484 | A | | 5/1998 | Trout |
| 5,829,613 | A | | 11/1998 | Wohlgemuth et al. |
| 5,894,124 | A | | 4/1999 | Iwabuchi et al. |
| 5,927,532 | A | | 7/1999 | Traub |
| 5,950,850 | A | * | 9/1999 | Takamatsu et al. ..... 215/252 |
| 6,015,054 | A | * | 1/2000 | King et al. ..... 215/252 |
| 6,056,136 | A | | 5/2000 | Taber et al. |
| 6,085,921 | A | | 7/2000 | Brown |
| 6,119,883 | A | | 9/2000 | Hock et al. |
| 6,305,579 | B1 | | 10/2001 | Long, Jr. |
| 6,382,444 | B1 | | 5/2002 | Nyman |
| 2002/0033374 | A1 | | 3/2002 | Ma |
| 2002/0062626 | A1 | | 5/2002 | Gregory |
| 2003/0071007 | A1 | | 4/2003 | Ma et al. |

FOREIGN PATENT DOCUMENTS

| | | |
|---|---|---|
| EP | 0 341 949 | 11/1989 |
| GB | 2 096 110 | 10/1982 |
| GB | 2 148 259 | 5/1985 |

* cited by examiner

CLOSURE AND CONTAINER SYSTEM AND METHOD FOR SEALING A CLOSURE ON A CONTAINER

FIELD OF THE INVENTION

The present invention relates generally to packages and containers. More particularly, the present invention regards a tamper-evident arrangement that maintains a seal between the closure and the container until after the tamper-evident arrangement has been severed from the closure.

BACKGROUND INFORMATION

Tamper evident seals have been used to increase consumer safety by showing whether a package has been opened after being produced. Embodiments of tamper evident indicators include a pop-up button in the center of a package and a break-away seal connected to the lower edge of a lid. The pop-up button has the disadvantage that it may be difficult to ascertain whether the seal has been broken. The break-away lower lid section may be too sensitive and may break away inadvertently during normal jostling. Alternatively, the break-away lower lid section may be insensitive to tampering or pilfering, and may not break away until after the seal between the closure and the container has been breached. The latter situation raises the possibility that the container may be accessed and resealed without breaking the tamper evident seal. This possibility undermines the purpose behind the tamper-evident seal, thereby reducing consumer confidence in a product sealed in this manner.

The following patents discuss tamper evident seals. U.S. Pat. No. 4,378,894 is believed to describe a tamper-evident screw threaded closure having bridges that fracture from the application of removal torque to the closure prior to breaking the seal between the liner and the container.

U.S. Pat. No. 4,448,318 is believed to describe a screw threaded closure for containers having a tamper-evident ring or band connected to the lower terminal edge of a skirt by at least a pair of fracturable bridge means. The bridge means are oriented in a predetermined manner relative to one another to effect sequential breaking in a given pattern upon relative movement of the cap portion and ring in the direction.

U.S. Pat. No. 4,534,480 is believed to describe a tamper evident closure for use on a screw threaded neck of a container. The closure includes a tamper evident band joined to the cap's sidewall by a plurality of bridge strips that are circumferentially aligned with ratchet teeth on the tamper evident band. During cap removal, the ratchet lugs stop the ratchet teeth and the tamper evident band from moving so that the band is separated from the cap, thereby providing an indication of tampering with the closure.

U.S. Pat. No. 4,567,991 is believed to describe a tamper indicating child resistant package including a screw type closure for use with a container having a threaded neck portion. A tamper indicating means is provided to maintain the lock element in circumferentially aligned relationship relative to the lock member, and is further provided with stop elements to cooperatively engage the stop lugs on the container. The tamper indicating means prevents removal of the closure before separating the tamper indicating means from the remainder of the closure, thereby giving evidence of tampering with the container.

U.S. Pat. No. 4,828,127 is believed to describe a tamper-evident screw-threaded closure in which the skirt of a cap is joined at its lower edge to a band by integral elongated breakable webs. The band has lugs which oppose circumferential, rather than axial, movement in the unscrewing direction.

U.S. Pat. No. 4,936,475 is believed to describe a tamper indicating closure and closure-container package in which a tamper indicating skirt depends from the bottom of the annular wall of a standard threaded cap. The skirt includes a plurality of equally spaced depending ribs that are joined at their extremities by a flexible ring. The ring and the skirt ribs pass over lugs on the container neck when the cap is being threaded onto the closure. When the cap is being unthreaded, the lugs engage the rings to sever them indicating tampering or prior opening.

U.S. Pat. No. 5,320,233 is believed to describe a lug cap or closure that is used in combination with a container for indicating that the container has been opened so as to indicate loss of seal or tampering. The lug cap includes an upper cap portion and a depending tamper or pilfer band, each having a series of circumferentially spaced lugs. The upper cap portion and the pilfer band are joined by a plurality of frangible bridges. The container finish includes combination camming/locking projections for locking the lugs into a locked position and for separating the pilfer band from the upper cap portion by a camming action when the container is opened.

U.S. Pat. No. 5,829,613 is believed to describe a container closure system comprising a threaded cap and a threaded neck wherein the cap is affixed to the neck by direct axial application so that the mating threads slip past one another and into engagement. The cap and neck include tamper-indication means to prevent removal of the cap without activation thereof.

U.S. Pat. No. 5,449,078 is believed to describe a combination of a container and a safety cap therefor in which the safety cap has a closure plane and a circumferential outer skirt for engaging a container and has a circumferential resilient depending inner member. The container has a rigid wall having an end for engagement with the cap internally of the outer skirt. The wall is tapered from a smaller diameter portion adjacent the closure plane of the cap to a larger diameter portion remote from the closure plane of the cap. The tapered wall of the container engages internally the resilient inner member of the cap and the larger diameter portion of the wall expands the resilient inner member outwardly to provide a working seal of the container as well as a bias on the cap in a direction of removal of the cap. The combination also includes means disposed on the container remotely from the end of the rigid wall and cooperative means on the cap for preventing the cap from being removed from the container without depression of the cap on the container and rotation of the cap on the container. When the container is used as a bottle, the container includes means for providing a tamper evident seal, whereby it is evident that the contents have been sealed with a material protecting the contents of the container. Any penetration of the seal prior to the removal and destruction of the seal by the user will be evidence of the lack of integrity of the contents of the container.

SUMMARY

An exemplary embodiment of the present invention includes a one-piece lug-style closure for a lug-style container. The tamper-evident closure is designed to fracture breakable connectors upon removal before the sealing liner is separated from the container's sealing surface.

The closure is designed with groups of two lugs that are separated from each other by a line of breakable connectors. The upper lug provides the clamping force to create a seal of the container and the lower lug provides the locking of the cap upon the container. The lower lug prevents the lower cap wall from moving upon cap removal, causing the breakable connectors to fracture, thereby indicating tampering. As a further indication of tampering, the lower cap wall will drop down and be separated vertically from the upper wall of the closure. The cap's breakable connectors fracture when the cap turns, before the upper cap wall rises vertically and separates from the lower wall. The container lugs are designed with a cam surface and a clamping surface for the cap's sealing lug. A triangular shaped vertical wall permits the cap's lock lug to cam over and lock the lower cap wall with the container.

A system is provided that includes a container including a sidewall and a bottom wall. A neck region on the sidewall may be adjacent to an opening. The opening may be opposite the bottom wall. The container may include projections spaced around the neck region. Each of the projections may include a cam surface, a lock surface, a ramp, and a clamping surface. The system may include a closure including a closure plane and a circumferentially depending outer skirt extending from the closure plane. A tamper-evident arrangement may be frangibly connected to an edge of the outer skirt opposite the closure plane. Pairs of lugs may be spaced around an inner sidewall formed by the outer skirt and the tamper-evident arrangement. A lock lug of each pair of lugs may be arranged on the tamper-evident arrangement and a sealing lug of each pair of lugs may be arranged on the outer skirt. Each lock lug may be adapted to engage the cam surface of a corresponding projection during an application operation. The lock lug may be adapted to engage the lock surface of the corresponding projection after the application operation. Each sealing lug may be adapted to engage the ramp of the corresponding projection during the application operation. The sealing lug may be adapted to engage the clamping surface of the corresponding projection after the application operation.

In the system, a number of pairs of lugs may be equal to a number of projections.

In the system, the closure and the container may cooperate to provide a tamper-evident closure with the container after the initial application operation. The lock lug may engage the lock surface to prevent removal of the closure until the tamper-evident arrangement detaches from the outer skirt.

In the system, the sealing lug may engage the clamping surface until after the tamper-evident arrangement detaches completely from the outer skirt.

In the system, the tamper-evident arrangement may detach from the outer skirt during a first removal operation.

In the system, the closure and the container may cooperate to provide a delay-release mechanism.

In the system, the delay-release mechanism may include the sealing lug and the clamping surface.

The system may further include a child-resistant lock surface adapted to engage the sealing lug in a sealed position and an inner wall on the closure arranged radially inward of the outer skirt. The inner wall may be adapted to engage the neck region of the container. The neck region or the inner wall may be tapered to provide a force biasing the closure open with respect to the container.

In the system, the child-resistant lock surface may prevent removal of the closure from the container until a further force opposing the force biasing the closure open is provided.

A method for sealing a closure on a container in a tamper-evident manner is provided that includes rotating the closure with respect to the container in a tightening direction until a lock lug of each of a pair of lugs first engages a cam surface of a corresponding projection spaced around a neck region of the container and further rotating the closure with respect to the container in the tightening direction until the lock lug of each pair of lugs engages a lock surface of the corresponding projection. In the method, the lock lug of each pair of lugs may be arranged on a tamper-evident arrangement and a sealing lug of each pair of lugs may be arranged on an outer skirt of the closure. In the method, each sealing lug may be adapted to engage a ramp of the corresponding projection during the rotating operation and to engage a clamping surface of the corresponding projection after the further rotating operation.

In the method, the pairs of lugs are spaced around an inner sidewall of the outer skirt of the closure and the tamper-evident arrangement.

In the method, the container may include a sidewall and bottom wall, the neck region being on the sidewall and being adjacent to an opening, the opening opposite the bottom wall.

In the method, the closure may include a closure plane and the outer skirt circumferentially extending from the closure plane; and the tamper-evident arrangement may be frangibly connected to an edge of the outer skirt opposite the closure plane.

In the method, a number of pairs of lugs equals a number of projections.

The method may further include, after the further rotating operation, engaging the lock surface by the lock lug to prevent removal of the closure until the tamper-evident arrangement is detached from the outer skirt.

The method may further include engaging the clamping surface by the sealing lug until after the tamper-evident arrangement detaches completely from the outer skirt.

The method may further include cooperating by the closure and the container to provide a delay-release mechanism.

In the method, the delay-release mechanism includes the sealing lug and the clamping surface.

The method may further include engaging the sealing lug in a sealed position by a child-resistant lock surface and engaging the neck region of the container by an inner wall arranged on the closure radially inward of the outer skirt. The neck region or the inner wall may be tapered to provide a force biasing the closure open with respect to the container.

The method may further include preventing removal of the closure from the container by the child-resistant lock surface until a further force opposing the force biasing the closure open is provided.

A method for removing a closure from a container that is sealed in a tamper-evident manner may include rotating the closure with respect to the container in a loosening direction; detaching a tamper-evident arrangement from an outer skirt of the closure; and maintaining a seal between the closure and the container by a sealing lug of each pair of lugs arranged on the outer skirt engaging a clamping surface of the corresponding projection until after the detaching operation.

The lock lug of each of a pair of lugs may engage a lock surface of a corresponding projection In the method, the pairs of lugs may be spaced around an inner sidewall of the outer skirt of the closure and the tamper-evident arrangement.

DETAILED DESCRIPTION

Figure 1:
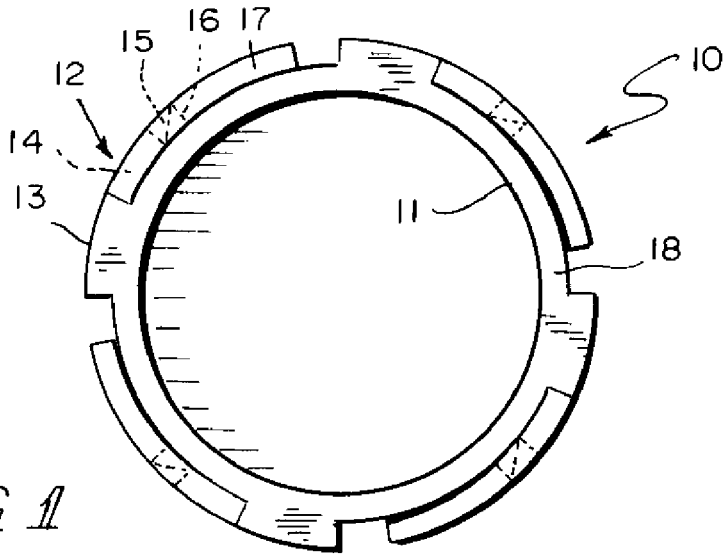
FIG. 1 illustrates a top view of a container according to an exemplary embodiment of the present invention.

FIG. 1 illustrates an exemplary embodiment of container 10. Container 10 includes projections 12 arranged circumferentially around the outside of neck 18 of a sidewall. Four projections 12 are shown in FIG. 1, though alternatively, more or fewer projections 12 may be provided. The sidewall defines an interior 11 of container 10. Projections 12 each include ramp 13, clamping surface 14, cam surface 15, and lock surface 16. Projections 12 define locking area 17.

Figure 2:
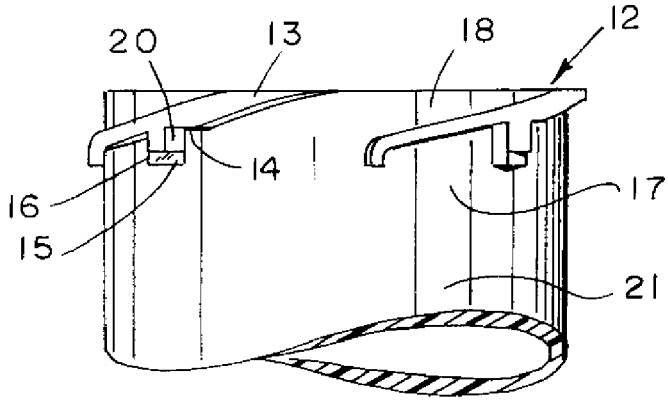
FIG. 2 illustrates a side view of a container neck according to an exemplary embodiment of the present invention.

FIG. 2 illustrates a side view of container 10 from FIG. 1. FIG. 2 shows neck 18 of sidewall 21, as well as two projections 12. Projections 12 each include ramp 13, clamping surface 14, cam surface 15, and lock surface 16. Projections 12 define locking area 17. Also shown in FIG. 2 is stop 20 of projections 12.

Figure 3B:
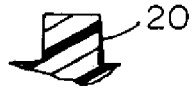
FIG. 3*b* illustrates a cross-sectional view of the projection of FIG. 3*a* taken along line IIIB—IIIB.
Figure 3A:
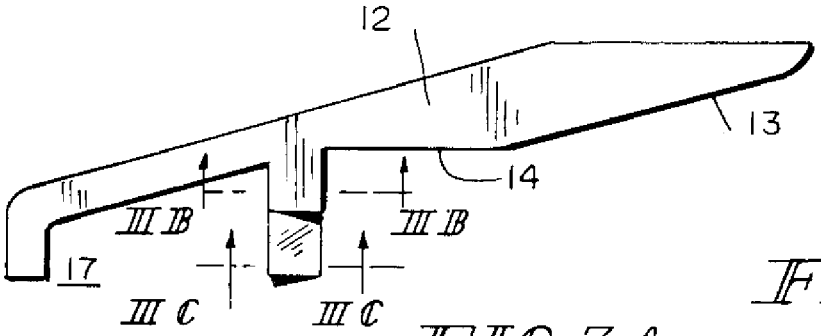
FIG. 3*a* illustrates a side view of a projection according to an exemplary embodiment of the present invention.

FIG. 3*a* illustrates an enlarged side view of projection 12 from FIGS. 1 and 2. Projection 12 includes ramp 13 and clamping surface 14. Locking area 17 is provided by projection 12.

FIG. 3*b* illustrates a cross-sectional view of the projection of FIG. 3*a* taken along line IIIB—IIIB. FIG. 3*b* illustrates the profile of stop 20, which is rectangular shaped.

Figure 3C:
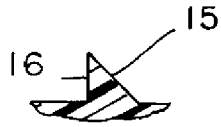
FIG. 3*c* illustrates a cross-sectional view of the projection of FIG. 3*a* taken along line IIIC—IIIC.

FIG. 3*c* illustrates a cross-sectional view of the projection of FIG. 3*a* taken along line IIIC—IIIC. FIG. 3*c* illustrates the profile of cam surface 15 in relation to the profile of lock surface 16.

Figure 4:
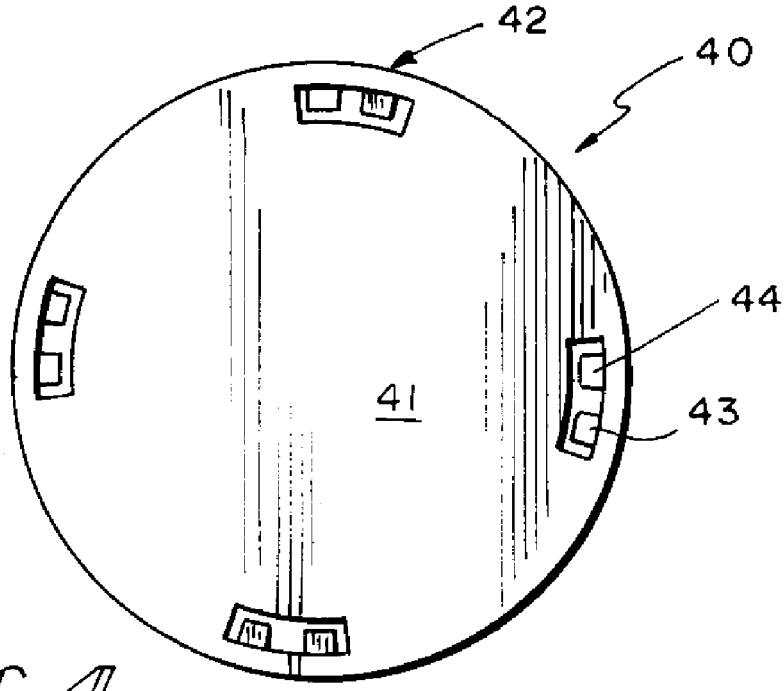
FIG. 4 illustrates a top view of a closure according to an exemplary embodiment of the present invention.

FIG. 4 illustrates a top view of closure 40 including closure plane 41. Arranged circumferentially and evenly spaced around the outside edge of closure 40 are pairs of lugs 42. Four pairs of lugs 42 are shown in FIG. 4, though more or fewer pairs of lugs 42 are possible. The number of pairs of lugs 42 may be the same as the number of projections on the corresponding container. Each pair of lugs 42 includes one lock lug 43 and one sealing lug 44. Closure plane 41 may include openings at or adjacent to one of lock lug 43 and sealing lug 44. Alternatively, closure plane 41 may be substantially continuous without any openings.

Figure 5:
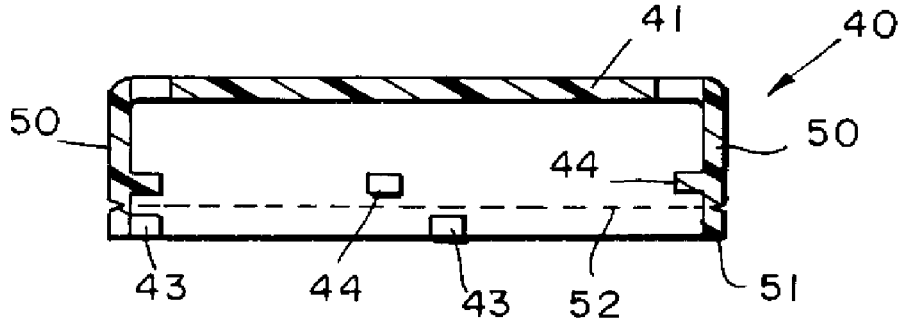
FIG. 5 illustrates a side, cross-sectional view of a closure including lugs according to an exemplary embodiment of the present invention.

FIG. 5 illustrates a side, cross-sectional view of closure 40 including lock lugs 43 and sealing lugs 44. Each sealing lug 44 is arranged on an inner sidewall of outer skirt 50. Each lock lug 43 is arranged on an inner sidewall of tamper-evident band 51. Tamper evident band 51 is attached to an edge of outer skirt 50 away from closure plane 41 by breakable connector 52, which may be for instance a notch knife cut. Sealing lug 44 and lock lug 43 near the center line of FIG. 5 are from different pairs of lugs. Specifically, sealing lug 44 near the center line of FIG. 5 is from a pair of lugs arranged on the distant side of outer skirt 50, while lock lug 43 is from a pair of lugs arranged on the near side of outer skirt 50.

Figure 6:
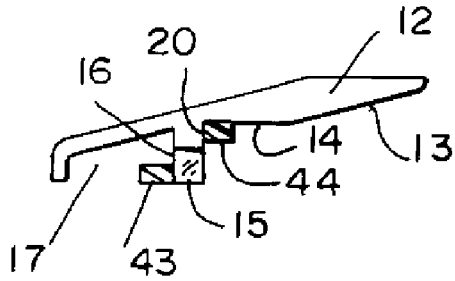
FIG. 6 illustrates a side, cross-sectional view of lugs from a closure engaging a projection from a container according to an exemplary embodiment of the present invention.

FIG. 6 illustrates a side view of sealing lug 44 and lock lug 43 engaging projection 12 in a position after initial application of the closure to the container. The closure has been applied to the container by tightening in a clockwise direction. As the closure is applied to the container, sealing lug 44 contacts ramp 13 causing the closure to seal the container and then contacts clamping surface 14 until sealing lug 44 contacts stop 20. In the same application operation, lock lug 43 contacts cam surface 15 and is cammed over projection 12 into locking area 17. Lock lug 43 is prevented from moving in a counter-clockwise direction by lock surface 16. The engagement between lock lug 43 and lock surface 16 prevents the removal of the closure until the tamper-evident band is removed.

Figure 7:
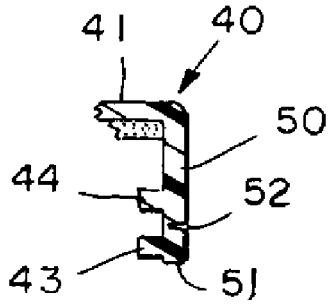
FIG. 7 illustrates a side, cross-sectional view of a projection on a container neck engaging lugs of a closure according to an exemplary embodiment of the present invention.

FIG. 7 illustrates a cross-sectional view of closure 40 showing closure plane 41, outer skirt 50, and tamper-evident band 51. On the inside wall of outer skirt 50 is sealing lug 44, and on the inside wall of tamper-evident band 51 is lock lug 43.

Figure 8:
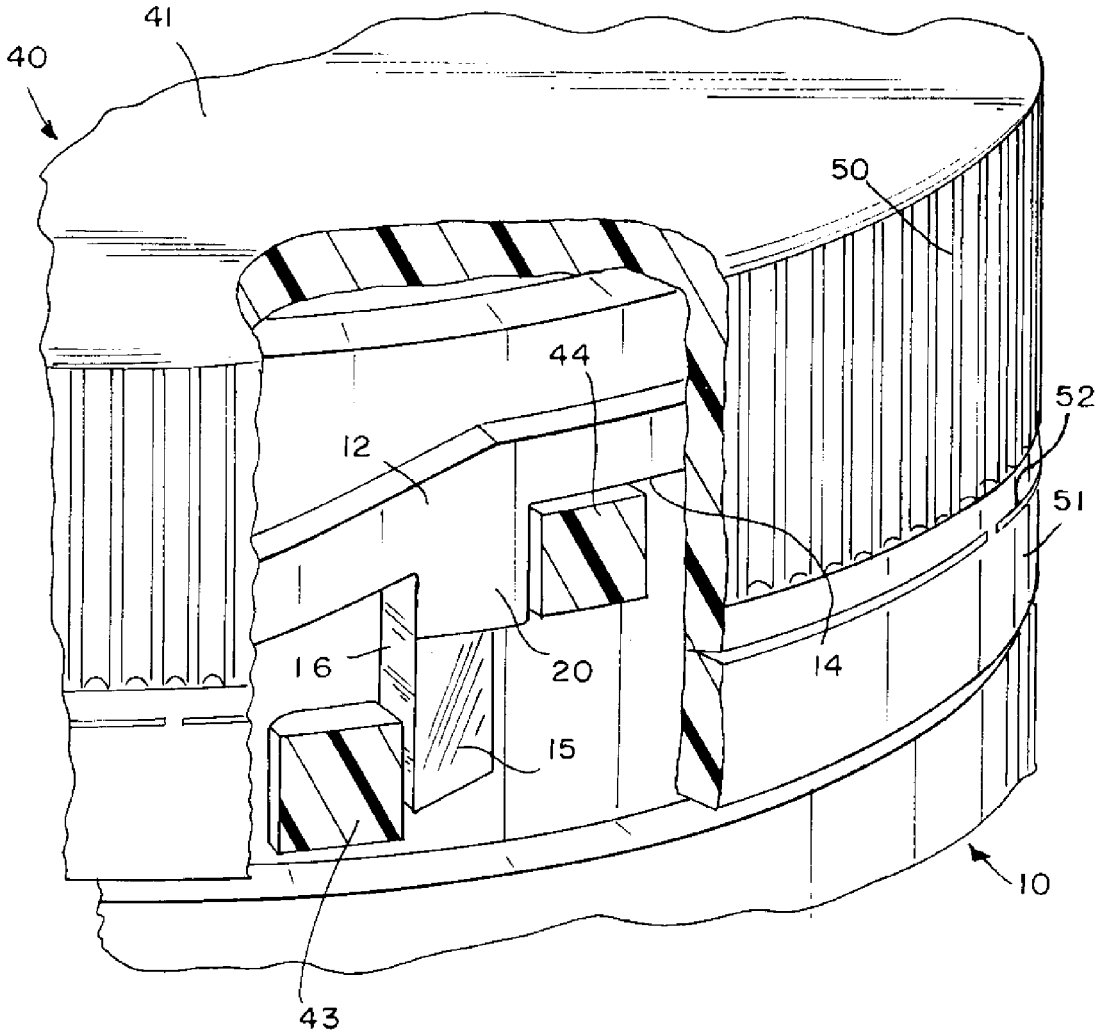
FIG. 8 illustrates a partial cut-away view of a closure on a container neck and showing lugs engaging a projection according to an exemplary embodiment of the present invention.

FIG. 8 illustrates a partial cut-away view of closure 40 on container 10. Closure 40 includes lock lug 43, sealing lug 44, closure plane 41, outer skirt 50, and tamper-evident band 51. Sealing lug 44 and lock lug 43 of closure 40 engage projection 12 of container 10. Closure 40 has been applied to container 10 by tightening in a clockwise direction. As closure 40 is applied to container 10, sealing lug 44 contacts clamping surface 14 and stop 20. lock lug 43 has cammed over cam surface 15 and is in locking area 17. Lock lug 43 is prevented from moving in a counter-clockwise direction by lock surface 16. The engagement between lock lug 43 and lock surface 16 prevents the removal of closure 40 until tamper-evident band 51 is removed. The engagement between lock lug 43 and lock surface 16 when a counter-clockwise force applied to closure 40 causes breakable connector 52 to shear, thereby causing tamper-evident band 51 to separate from outer skirt 50.

Figure 9:
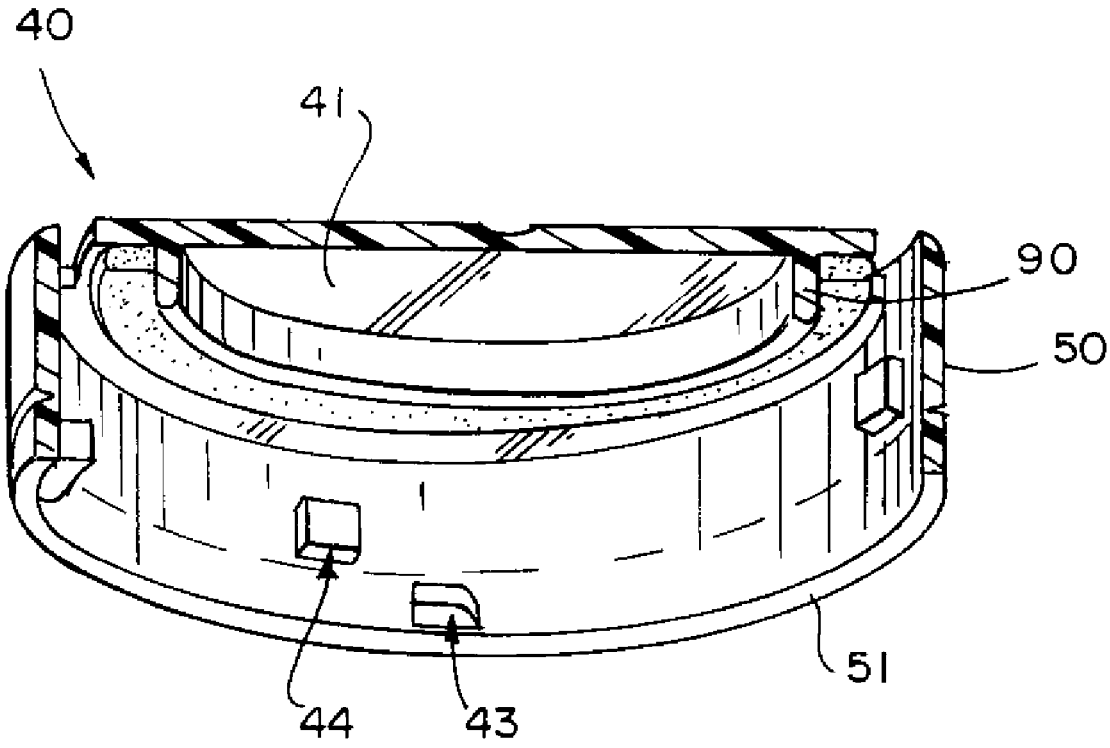
FIG. 9 illustrates a partial cut-away view of a closure according to another exemplary embodiment of the present invention.

FIG. 9 illustrates a partial cut-away view of closure 40 in another exemplary embodiment of the present invention. Closure 40 includes lock lug 43, sealing lug 44, closure plane 41, outer skirt 50, and tamper-evident band 51. Additionally, closure 40 includes inner wall 90, which circumferentially extends from closure plane 41 in the same direction as outer skirt 50. Inner wall 90 is arranged radially inward from outer skirt 50.

Figure 10:
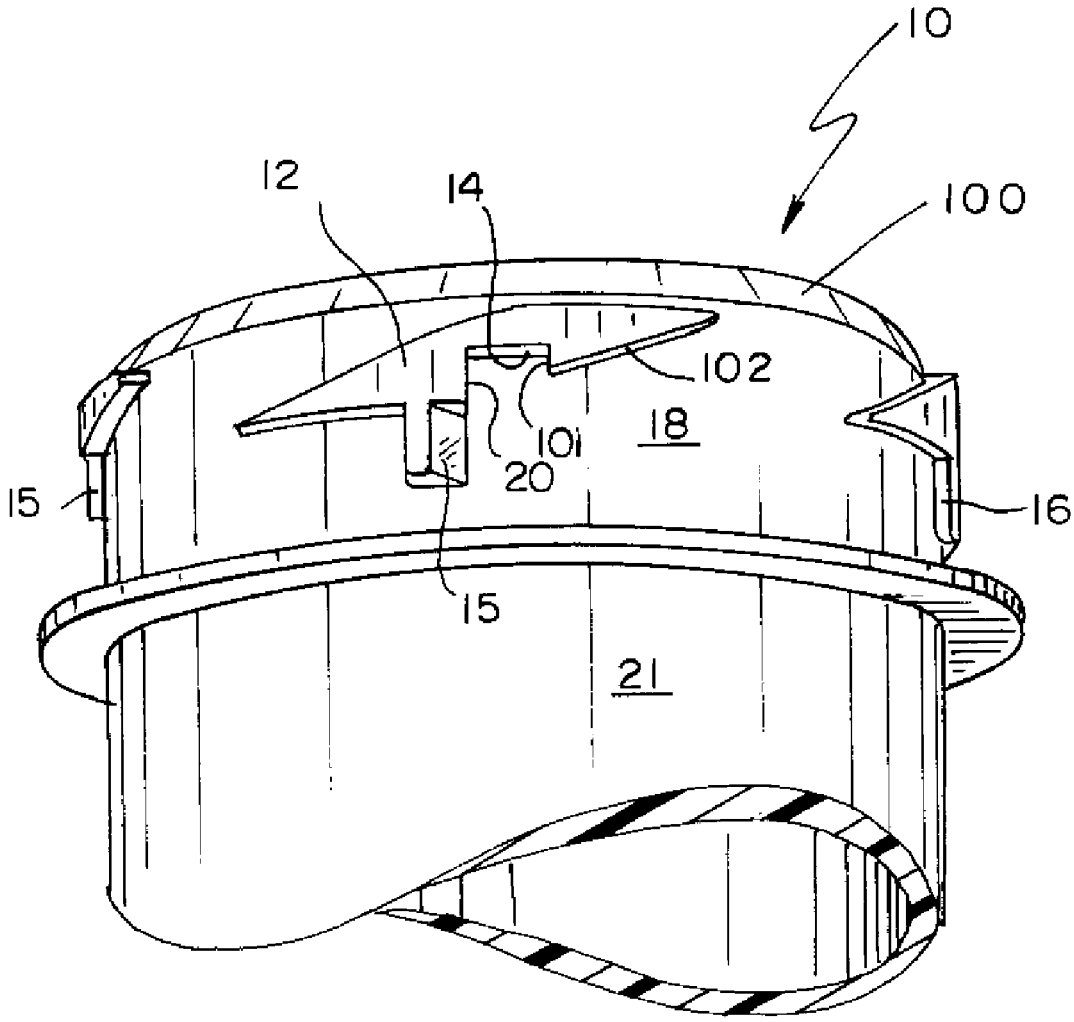
FIG. 10 illustrates a side view of a container according to the exemplary embodiment of the present invention shown in FIG. 9.

FIG. 10 illustrates a side view of container 10 cooperable with the exemplary embodiment of the closure shown in FIG. 9. Container 10 includes sidewall 21 including neck 18. On a top edge of neck 18 is tapered biasing surface 100. Tapered biasing surface 100 tapers radially inward towards the edge of neck 18. Tapered biasing surface 100 is adapted to engage with an inner wall of a closure to bias the closure open. Tapered biasing surface 100 may taper radially inwards, in which an outside diameter of neck 18 is smaller at the top edge than away from the edge. This type of taper for tapered biasing surface 100 is adapted to engage with an inner wall that lies on a radius on the closure of equal or greater size than the radius of the top edge of tapered biasing surface 100. Therefore, when the closure is applied to container 10, the inner wall of the closure contacts tapered biasing surface 100 on a radially outside surface. The inner wall and/or tapered biasing surface 100 deform as pressure is applied to close the closure on container 10. The reaction against this deformation by the inner wall and/or tapered biasing surface 100 causes the biasing open of the closure with respect to container 10.

Alternatively, tapered biasing surface 100 may taper radially outward toward the edge of neck 18, and therefore an inside radius of neck 18 may be larger at the top edge than away from the edge. This type of taper for tapered biasing surface 100 is adapted to engage with an inner wall that lies on an inner radius on the closure. Therefore, when the closure is applied to container 10, the inner wall of the closure contacts tapered biasing surface 100 on a radially inside surface.

In alternative embodiments, neck 18 may or may not be tapered, and the inner wall of the closure is tapered. The inner wall of the closure may be tapered inward or outward, and the inner wall may lie radially inwards or radially outwards, respectively. The engagement of the inner wall and neck 18 may provide the appropriate biasing of the closure with respect to the container.

FIG. 10 illustrates an alternative embodiment of projection 12. Projection 12 of FIG. 10 includes child-resistant lock surface 101 and steep ramp 102. Steep ramp 102 engages with a sealing lug of a closure when the closure is being applied to container 10. The engagement between steep ramp 102 and a sealing lug is opposed by the interaction between tapered biasing surface 100 and the inner wall of the closure. If the closure continues to be turned in the clockwise direction as the sealing lug reaches the end of steep ramp 102, the sealing lug passes onto sealing surface 14. Because sealing surface 14 is positioned closer to the top edge of neck 18 (tapered biasing surface 100), the closure then releases slightly the mutual deformation of tapered biasing surface 100 and the inner wall. Tapered biasing surface 100 continues to contact the inner wall of the closure to cause a bias (and possibly a seal) in this position. The area between the edge of steep ramp 102 and sealing surface 14 forms child resistant lock surface 101. Child resistant lock surface 101 prevents the removal of the closure from container 10 by simply turning in a counter-clockwise direction. In order to remove the closure from container 10, a downward force on the closure with respect to container 10 is required to oppose the biasing of tapered biasing surface 100 and the inner wall of the closure. Sufficient downward force is required to oppose this biasing to move the sealing lug below the lowest point of child resistant lock surface 101. After the sealing lug is below the lowest point of child resistant lock surface 101, child resistant lock surface 101 no longer prevents counter-clockwise movement of the closure with respect to container 10. Therefore, the closure can be removed by rotating it counter-clockwise. After moving the closure a distance in the counter-clockwise direction in order to position the sealing lug on steep ramp 102, the downward force opposing the biasing of the tapered biasing surface 100 and the inner wall of the closure may be maintained, reduced, or eliminated. Continued turning in the counter-clockwise direction removes the closure from container 10.

Projection 12 of FIG. 10 also includes stop 20, cam surface 15, and lock surface 16, which operate in a similar manner to that described above. Specifically, the tamper-evident band of the closure prevents the movement of the closure on container 10 after the initial positioning of the closure on container 10 until the shear forces between the tamper-evident band and the outer skirt break the breakable connectors.

While the present invention has been described in connection with the foregoing exemplary embodiments, it should be readily apparent to those of ordinary skill in the art that these embodiments are exemplary in nature and is not to be construed as limiting the scope of protection for the invention as set forth in the appended claims.

What is claimed is:

1. A system, comprising:

a container including a sidewall and a bottom wall, a neck region on the sidewall adjacent to an opening opposite the bottom wall, the container including projections spaced around the neck region, each projection including a cam surface, a lock surface, a ramp, and a clamping surface;

a closure including a closure plane and a circumferentially depending outer skirt extending from the closure plane, a tamper-evident arrangement frangibly connected to an edge of the outer skirt opposite the closure plane, pairs of lugs spaced around an inner sidewall formed by the outer skirt and the tamper-evident arrangement, a lock lug of each pair of lugs arranged on the tamper-evident arrangement and a sealing lug of each pair of lugs arranged on the outer skirt;

wherein each lock lug is adapted to engage the cam surface of a corresponding projection during application of the closure to the container, the lock lug adapted to engage the lock surface of the corresponding projection after application of the closure to the container;

wherein each sealing lug is adapted to engage the ramp of the corresponding projection during application of the closure to the container, the sealing lug adapted to engage the clamping surface of the corresponding projection after application of the closure to the container;

wherein the closure and the container cooperate to provide a tamper-evident closure with the container after the application of the closure to the container, the lock lug configured to engage the lock surface to prevent removal of the closure until the tamper-evident arrangement detaches from the outer skirt, and wherein the sealing lug is configured to engage the clamping surface until after the tamper-evident arrangement detaches completely from the outer skirt.

2. The system of claim 1, wherein a number of pairs of lugs is equal to a number of projections.

3. The system of claim 1, wherein the tamper-evident arrangement is configured to detach from the outer skirt during a first turning operation of the closure relative to the container.

4. The system of claim 1, wherein the closure and the container cooperate to provide a delay-release mechanism configured to retain the closure in a sealing position relative to the container until after separation of the tamper-evident arrangement from the outer skirt.

5. The system of claim 1, further comprising: a child-resistant lock surface adapted to engage the sealing lug in a sealed position; and an inner wall on the closure arranged radially inward of the outer skirt, the inner wall adapted to engage the neck region of the container, one of the neck region and the inner wall tapered to provide a force to bias the closure open with respect to the container.

6. The system of claim 5, wherein the child-resistant lock surface is adapted to prevent removal of the closure from the container until a further force opposing the force that biases the closure open is provided.

7. A system, comprising:

a container including a sidewall and a bottom wall, a neck region on the sidewall adjacent to an opening opposite the bottom wall, the container including projections spaced around the neck region, each projection including a cam surface, a lock surface, a ramp, and a clamping surface;

a closure including a closure plane and a circumferentially depending outer skirt extending from the closure plane, a tamper-evident arrangement frangibly connected to an edge of the outer skirt opposite the closure plane, pairs of lugs spaced around an inner sidewall formed by the outer skirt and the tamper-evident arrangement, a lock lug of each pair of lugs arranged on the tamper-evident arrangement and a sealing lug of each pair of lugs arranged on the outer skirt;

wherein each lock lug is adapted to engage the cam surface of a corresponding projection during application of the closure to the container, the lock lug adapted to engage the lock surface of the corresponding projection after application of the closure to the container;

wherein each sealing lug is adapted to engage the ramp of the corresponding projection during application of the closure to the container, the sealing lug adapted to engage the clamping surface of the corresponding projection after application of the closure to the container;

wherein the closure and the container cooperate to provide a delay-release mechanism configured to retain the closure in a sealing position relative to the container until after separation of the tamper-evident arrangement from the outer skirt; and wherein the delay-release mechanism includes the sealing lug and the clamping surface.

8. A method for sealing a closure on a container in a tamper-evident manner, the closure including a lock lug arranged on a tamper-evident arrangement of the closure and a sealing lug arranged on an outer skirt of the closure, comprising:

(a) rotating the closure with respect to the container in a first direction so that the sealing lug engages a ramp of a corresponding projection arranged on a neck region of the container, the engagement of the sealing lug and the ramp causing the closure and the container to move in an axial direction toward each other;

(b) after the rotating step (a), rotating the closure with respect to the container in the first direction so that the lock lug engages a cam surface of the corresponding projection and so that the sealing lug engages a clamping surface of the corresponding projection, the engagement of the sealing lug and the clamping surface preventing movement of the closure and the container in the axial direction away from each other;

(c) after the rotating step (b), rotating the closure with respect to the container in the first direction so that the lock lug engages a lock surface of the corresponding projection, the engagement of the lock surface and the lock lug preventing rotation of the closure with respect to the container in a second direction opposite the first direction until the tamper-evident arrangement is frangibly detached from the outer skirt.

9. The method of claim 8, wherein the closure includes a plurality of the lock lugs and the sealing lugs spaced around an inner sidewall of the outer skirt of the closure and the tamper-evident arrangement.

10. The method of claim 8, wherein the container includes a sidewall and a bottom wall, the neck region arranged on the sidewall and adjacent to an opening, the opening opposite the bottom wall.

11. The method of claim 8, wherein the closure includes a closure plane and the outer skirt circumferentially extends from the closure plane, and the tamper-evident arrangement is frangibly connected to an edge of the outer skirt opposite the closure plane.

12. The method of claim 8, wherein the closure includes a number of pairs of the lock lugs and sealing lugs is equal to a number of projections provided on the container.

13. The method of claim 8, further comprising engaging the clamping surface by the sealing lug until after the tamper-evident arrangement detaches completely from the outer skirt.

14. The method of claim 8, further comprising cooperating by the closure and the container to provide a delay-release mechanism.

15. The method of claim 14, wherein the delay-release mechanism includes the sealing lug and the clamping surface.

16. The method of claim 8, further comprising: engaging the sealing lug in a sealed position by a child-resistant lock surface; and engaging the neck region of the container by an inner wall arranged on the closure radially inward of the outer skirt, one of the neck region and the inner wall tapered to provide a force to bias the closure in an axial direction away from the container.

17. The method of claim 16, further comprising preventing removal of the closure from the container by the child-resistant lock surface until a further force opposing the force biasing the closure open is provided.

* * * * *